US008519927B2

(12) United States Patent
Mizuno

(10) Patent No.: US 8,519,927 B2
(45) Date of Patent: Aug. 27, 2013

(54) DISPLAY CONTROL APPARATUS AND METHOD OF DETERMINING DRIVING PARAMETER FOR OVERDRIVE

(75) Inventor: Ryosuke Mizuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 472 days.

(21) Appl. No.: 12/463,639

(22) Filed: May 11, 2009

(65) Prior Publication Data

US 2009/0295827 A1 Dec. 3, 2009

(30) Foreign Application Priority Data

May 28, 2008 (JP) ..... 2008-140035

(51) Int. Cl.
*G09G 3/36* (2006.01)

(52) U.S. Cl.
USPC ..... 345/88

(58) Field of Classification Search
USPC ..... 345/87–93; 348/177–191
See application file for complete search history.

(56) References Cited

U.S. PATENT DOCUMENTS

| | | | | |
|---|---|---|---|---|
| 5,583,560 | A * | 12/1996 | Florin et al. | 725/40 |
| 5,945,985 | A * | 8/1999 | Babin et al. | 715/209 |
| 6,084,564 | A * | 7/2000 | Ohara et al. | 345/20 |
| 6,100,886 | A * | 8/2000 | Lin | 715/709 |
| 6,278,433 | B2 * | 8/2001 | Narui | 345/581 |
| 6,292,216 | B1 * | 9/2001 | Shimizu et al. | 348/177 |
| 6,501,451 | B1 | 12/2002 | Sakashita | 345/87 |
| 6,686,953 | B1 * | 2/2004 | Holmes | 348/179 |
| 7,084,846 | B2 | 8/2006 | Adachi et al. | 345/89 |
| 7,345,700 | B2 * | 3/2008 | Nortrup | 348/180 |
| 7,397,457 | B2 | 7/2008 | Sugino et al. | 345/89 |
| 7,600,192 | B1 * | 10/2009 | Hashimoto et al. | 715/802 |
| 7,937,726 | B2 * | 5/2011 | Nashida et al. | 725/46 |
| 8,112,718 | B2 * | 2/2012 | Nezu et al. | 715/810 |
| 2001/0038369 | A1 | 11/2001 | Adachi et al. | 345/87 |
| 2003/0038768 | A1 | 2/2003 | Sakashita | 345/87 |
| 2004/0201564 | A1 | 10/2004 | Sugino et al. | 345/101 |
| 2004/0255325 | A1 * | 12/2004 | Furui et al. | 725/61 |
| 2005/0073530 | A1 * | 4/2005 | Kapur et al. | 345/594 |
| 2006/0279633 | A1 * | 12/2006 | Oka | 348/187 |
| 2007/0088966 | A1 * | 4/2007 | Price et al. | 713/324 |
| 2007/0164949 | A1 * | 7/2007 | Lee et al. | 345/87 |
| 2008/0252583 | A1 | 10/2008 | Sakashita et al. | 345/90 |

FOREIGN PATENT DOCUMENTS

| | | |
|---|---|---|
| JP | 2001-343956 | 12/2001 |
| JP | 3305240 | 5/2002 |
| JP | 2005-70799 | 3/2005 |
| JP | 2006-243325 | 9/2006 |

* cited by examiner

*Primary Examiner* — Alexander Eisen
*Assistant Examiner* — Sanjiv D Patel
(74) *Attorney, Agent, or Firm* — Fitzpatrick, Cella, Harper & Scinto

(57) ABSTRACT

In order to allow a user to more easily set a correction amount in overdrive (OD) driving of a liquid crystal display device, a display control apparatus which determines a driving parameter for overdrive of the liquid crystal display device includes a first display unit which repeatedly scrolls a preset reference pattern image in one direction, a second display unit which statically displays a plurality of sample images identical to the reference pattern image and having pseudo-afterimage regions whose end portions in a scroll direction are different from each other, a selection acceptance unit which accepts selection of one sample image of the plurality of sample images, and a determination unit which determines the driving parameter for overdrive based on the difference between the pixel value of the pseudo-afterimage region of a selected sample image and the pixel value of the reference pattern image.

4 Claims, 9 Drawing Sheets

DISPLAY CONTROL APPARATUS AND METHOD OF DETERMINING DRIVING PARAMETER FOR OVERDRIVE

BACKGROUND OF THE INVENTION

1. Field of the Invention

The present invention relates to a technique of determining a driving parameter for overdrive of a liquid crystal display device.

2. Description of the Related Art

Recently, liquid crystal display devices have been used as TV receivers and the display devices of PCs. However, in a liquid crystal display device, the response speed of the liquid crystal is relatively low until actual display with respect to the change rate (e.g., frame rate) of an input video signal, and hence an afterimage can be generated when, for example, a moving image is displayed. As a driving method for improving the response speed of a liquid crystal display device, there has been proposed a so-called overdrive driving method of correcting and outputting the video signal of the current display frame in accordance with a combination of a video signal of a display frame (current display frame) as a current display target and the video signal of the immediately preceding display frame (for example, Japanese Patent No. 3305240).

In addition, Japanese Patent Laid-Open No. 2001-343956 discloses a method of enhancing the effect of improving liquid crystal response speed by driving one frame upon dividing it into fields, and performing overdrive driving for the first field.

FIG. 10 is a block diagram for explaining an overdrive driving circuit. Referring to FIG. 10, reference numeral 1000 denotes an overdrive correction processing unit; 120, a frame memory; and 110, a display output unit. The overdrive correction processing unit 1000 includes a correction amount determination unit 1001, a correction table 1002, and a correction amount adding unit 1003.

The overdrive correction processing unit 1000 receives the video signal of the current frame and the video signal of the immediately preceding frame stored in the frame memory 120. The correction amount determination unit 1001 calculates a correction amount in accordance with a combination of the signal levels of the two frames. If, for example, the video signal level of the current frame is higher than that of the immediately preceding frame, the correction amount determination unit 1001 calculates a correction amount so as to drive the liquid crystal panel at a liquid crystal driving voltage higher than a normal driving voltage. In contrast, if the video signal level of the current frame is lower than that of the immediately preceding frame, the correction amount determination unit 1001 calculates a correction amount so as to drive the liquid crystal panel at a liquid crystal driving voltage lower than the normal liquid crystal driving voltage.

The correction amount determination unit 1001 reads out a correction amount corresponding to a combination of video signal levels by referring to the correction table 1002. Note that only representative combinations of video signal levels may be stored in the correction table 1002, and other combinations may be calculated by using an interpolation function. The data to be stored in the correction table 1002 are determined based on the result obtained by measuring a liquid crystal response speed for each signal level combination.

The correction amount adding unit 1003 adds or subtracts the correction amount determined by the correction amount determination unit 1001 to or from the video signal of the current frame. The display output unit 110 converts the corrected input video signal into a liquid crystal panel driving signal.

It is known that a liquid crystal response speed changes depending on an operating environment such as a temperature. That is, depending on an operating environment, the liquid crystal response speed which is set when data to be stored in the correction table 1002 is determined differs from the liquid crystal response speed of an actually used display device. In this case, a calculated overdrive driving correction amount is not an appropriate value, and hence the liquid crystal response speed cannot be sufficiently improved. In addition, an edge portion of a moving image is unnaturally colored.

Japanese Patent Laid-Open No. 2005-70799 discloses a liquid crystal display device which stops overdrive driving based on an instruction from a user or changes the enhancement conversion degree. In addition, Japanese Patent Laid-Open No. 2006-243325 discloses a liquid crystal display device which is provided with an arithmetic circuit so as to reduce a correction table to be used when a correction amount is to be changed in accordance with the temperature of the liquid crystal display device, an instruction from the user, the characteristics of an image, and the like.

When the correction amount for overdrive driving is to be adjusted by user operation, the user may adjust the correction amount without specifically knowing what kind of image a target image is. In addition, the user may set a correction amount with a purpose different from the primary purpose of implementing overdrive driving. Setting an inappropriate correction amount in this manner will lead to problems such as coloring of an edge portion of a moving image and an increase in noise.

The present invention provides a technique of allowing a user to more easily set a correction amount in overdrive driving of a liquid crystal display device.

SUMMARY OF THE INVENTION

According to one aspect of the present invention, a display control apparatus which determines a driving parameter for overdrive of a liquid crystal display device, the apparatus comprises: a first display unit which repeatedly scrolls a preset reference pattern image in a first region of the liquid crystal display device in one direction; a second display unit which statically displays, in a second region of the liquid crystal display device, a plurality of sample images identical to the reference pattern image and having pseudo-afterimage regions whose end portions in a direction of the scrolling are different from each other; a selection acceptance unit which accepts selection of one sample image of the plurality of sample images statically displayed in the second region from a user; and a determination unit which determines the driving parameter for overdrive based on a difference between a pixel value of the pseudo-afterimage region of a selected sample image and a pixel value of a region corresponding to the pseudo-afterimage region of the reference pattern image.

According to another aspect of the present invention, a display control apparatus which determines a driving parameter for overdrive of a liquid crystal display device, the apparatus comprises: a first display unit which repeatedly scrolls a preset reference pattern image in a first region of the liquid crystal display device in one direction; a second display unit which statically displays, in a second region of the liquid crystal display device, a sample image identical to the reference pattern image and having a pseudo-afterimage region whose end portion in a direction of the scrolling changes in accordance with user operation using an operation unit; a selection acceptance unit which accepts, from a user, selection of one sample image of the plurality of sample images statically displayed in the second region; and a determination unit which determines the driving parameter for overdrive based on a difference between a pixel value of the pseudo-afterimage region of a sample image adjusted by a user and a pixel value of a region corresponding to the pseudo-afterimage region of the reference pattern image.

According to still another aspect of the present invention, a method of determining a driving parameter for overdrive of a liquid crystal display device, the method comprises: a first display step of repeatedly scrolling a preset reference pattern image in a first region of the liquid crystal display device in one direction; a second display step of statically displaying, in a second region of the liquid crystal display device, a plurality of sample images identical to the reference pattern image and sample images having pseudo-afterimage regions whose end portions in a direction of the scrolling are different from each other; a selection acceptance step of accepting selection of one sample image of the plurality of sample images statically displayed in the second region from a user; and a determination step of determining the driving parameter for overdrive based on a difference between a pixel value of the pseudo-afterimage region of a selected sample image and a pixel value of a region corresponding to the pseudo-afterimage region of the reference pattern image.

According to the present invention, there is provided a technique of allowing a user to more easily set a correction amount in overdrive (OD) driving of a liquid crystal display device.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

The preferred embodiments of the present invention will be described in detail below with reference to the accompanying drawings. Note that the following embodiments are merely examples, and do not limit the scope of the present invention.

First Embodiment

A liquid crystal display device will be exemplarily described below as the first embodiment of a display control apparatus according to the present invention.

<Device Arrangement>

Figure 1:
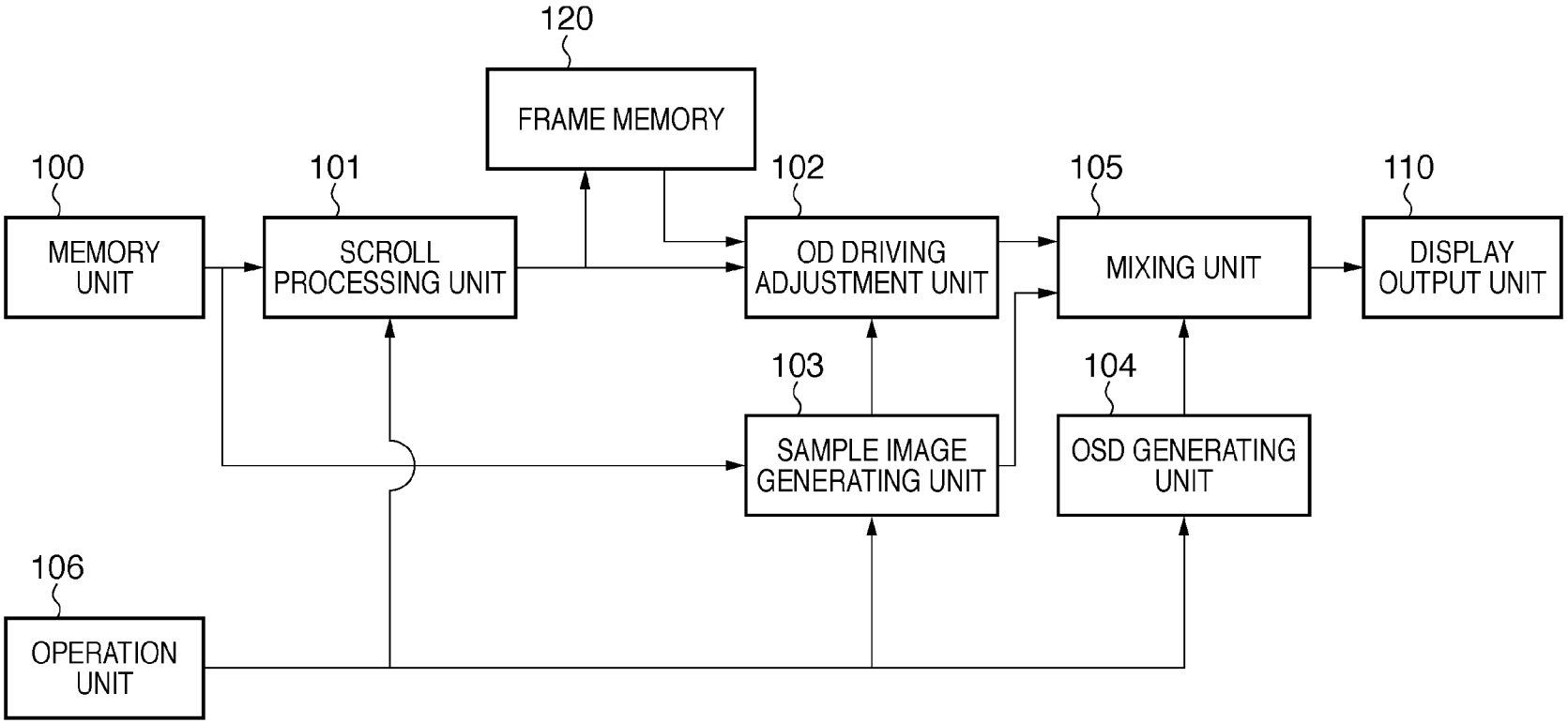
FIG. 1 is a block diagram showing the internal arrangement of a liquid crystal display device according to the first embodiment.

FIG. 1 is a block diagram showing the internal arrangement of a liquid crystal display device according to the first embodiment.

Figure 10:
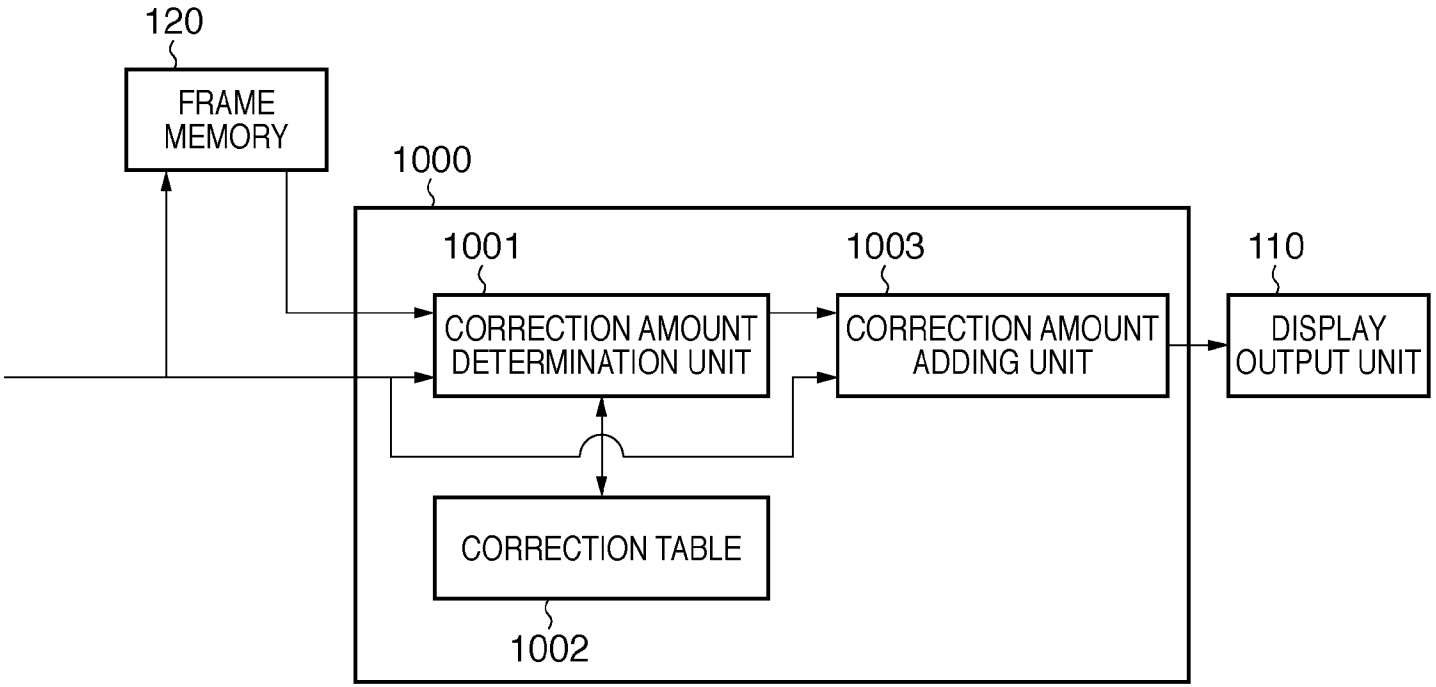
FIG. 10 is a block diagram for explaining an overdrive driving circuit.

Reference numeral 100 denotes a memory unit which stores the image data of a fixed pattern (to be described later); 101, a scroll processing unit for scrolling the image data of the fixed pattern; and 102, an OD driving adjustment unit which performs signal processing for OD (overdrive) driving for the moving image output from the scroll processing unit 101. Note that the OD driving adjustment unit 102 corresponds to an overdrive correction processing unit 1000 in FIG. 10. Note, however, that the OD driving adjustment unit 102 differs from the unit 1000 in FIG. 10 in that the unit 102 is configured to adjust a correction amount based on a parameter input from a sample image generating unit 103 (to be described later).

The sample image generating unit 103 generates a sample image (to be described later) based on the image data of a fixed pattern. Reference numeral 104 denotes an OSD (On-Screen Display) generating unit which generates a window for a user interface; 105, a mixing unit for forming the images generated by the OD driving adjustment unit 102, the sample image generating unit 103, and the OSD generating unit 104 into one window; and 106, an operation unit for accepting operation from a user. This unit includes a keyboard, mouse, and remote controller. Note that the operation unit 106 corresponds to the selection acceptance unit in the appended claims. A display output unit 110 and a frame memory 120 are identical to those shown in FIG. 10, and hence a repetitive description will be omitted.

Figure 2:
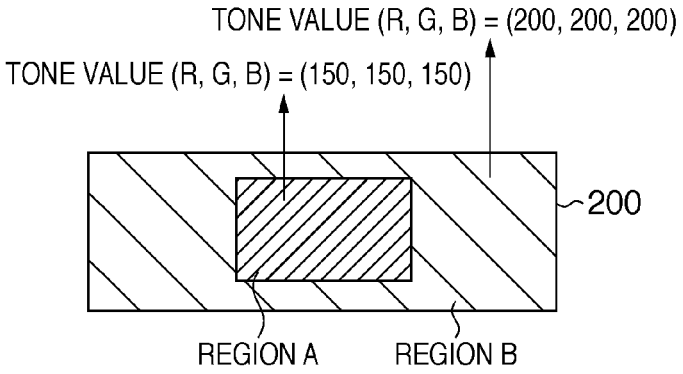
FIG. 2 is a view showing an example of the image data of a fixed pattern stored in a memory unit 100.

FIG. 2 is a view showing an example of the image data of a fixed pattern stored in the memory unit 100. Image data 200 of a fixed pattern is a reference pattern image serving as a reference for a "scroll pattern" and a "sample image" (to be described later). For the sake of simplicity, assume that the image data 200 of the fixed pattern is rectangular image data constituted by regions (regions A and B) having two different tone values. More specifically, assume that the region A is deep (dark) gray represented by (R, G, B)=(150, 150, 150), and the region B is pale (light) gray represented by (R, G, B)=(200, 200, 200). Note that red (R), green (G), and blue (B) each are expressed by 256 (8 bits) tones. It is preferable that tone combinations which exhibit large change amounts of response speed, in particular, due to a difference in operating environment and the like be selected as two kinds of tones included in a fixed pattern.

Although the following description is based on the assumption that only one kind of image data 200 is stored in the memory unit 100, it suffices to store the image data of different fixed patterns. It also suffices to store a pattern image other than a gray image. Furthermore, the memory unit 100 may store a moving image instead of a still image. In this case, this device need not be provided with the scroll processing unit 101.

Scroll Pattern

Figure 3:
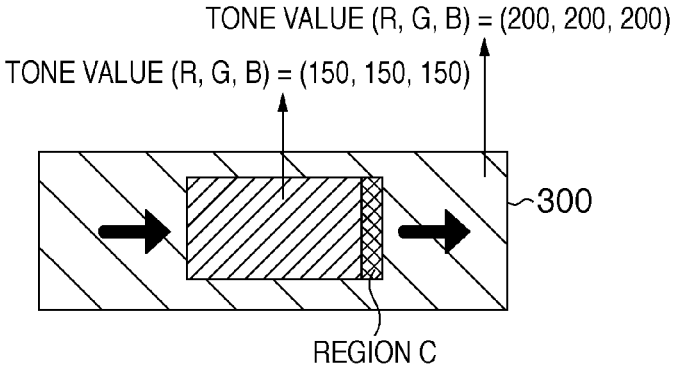
FIG. 3 is a view for explaining a scroll pattern output by a scroll processing unit 101.

FIG. 3 is a view for explaining a scroll pattern output by the scroll processing unit 101.

The scroll processing unit 101 reads out the image data 200 from the memory unit 100, and performs processing to scroll the image data 200 on a liquid crystal display unit (not shown) connected to the display output unit 110. In this case, to scroll is to move and display an image on the liquid crystal display unit in a predetermined direction at a predetermined speed. Note that the scroll processing unit 101 corresponds to the first display unit in the appended claims.

When, for example, scrolling an image to the right (in one direction) by 16 pixels per frame, the scroll processing unit 101 reads out the image data 200 from the memory unit 100 while shifting it to the right by 16 pixels per frame, and outputs the readout result. Performing such control will scroll the deep gray rectangular image (region A) on the pale gray image (region B) as a background image to the right by 16 pixels per frame. A moving image obtained by scroll processing will be referred to as a "scroll pattern" hereinafter.

The OD driving adjustment unit 102 calculates a correction amount in accordance with a combination of the scroll pattern output from the scroll processing unit 101 and the scroll pattern of the immediately preceding frame temporarily stored in the frame memory 120. The OD driving adjustment unit 102 generates an image signal for overdrive driving by adding or subtracting the calculated correction amount to or from the image signal of the scroll pattern of the current display frame.

Note that if no optimal correction amount is provided by the OD driving adjustment unit 102, it is impossible to sufficiently improve a response speed for a tone change between frames. In addition, for example, an edge portion of a moving image exhibiting a large tone change between frames is unnaturally colored, or an image is displayed with an afterimage being left. For this reason, if no optimal correction amount is provided when the image data 200 is scrolled to the right at a predetermined speed, a region where a tone change occurs between frames, for example, a portion near a right end region or left end region of the region A, is also colored, or an afterimage is generated.

Reference numeral 300 denotes a scroll pattern. A region C is a region in which the tone value changes between display frames (i.e., between the current display frame and the immediately preceding display frame). In this case, a region in which a tone value changes from (R, G, B)=(200, 200, 200) to (R, G, B)=(150, 150, 150) is shown as the region C. Overdrive driving is performed based on the correction amount calculated from a combination of tone value (R, G, B)=(200, 200, 200) of the immediately preceding frame and tone value (R, G, B)=(150, 150, 150) of the current frame. For this reason, if a correction amount for this combination is not optimal, the above trouble of coloring occurs. That is, the region C indicates a region in which coloring occurs if the OD driving adjustment unit 102 does not provide an appropriate correction amount.

Sample Image

Figure 4:
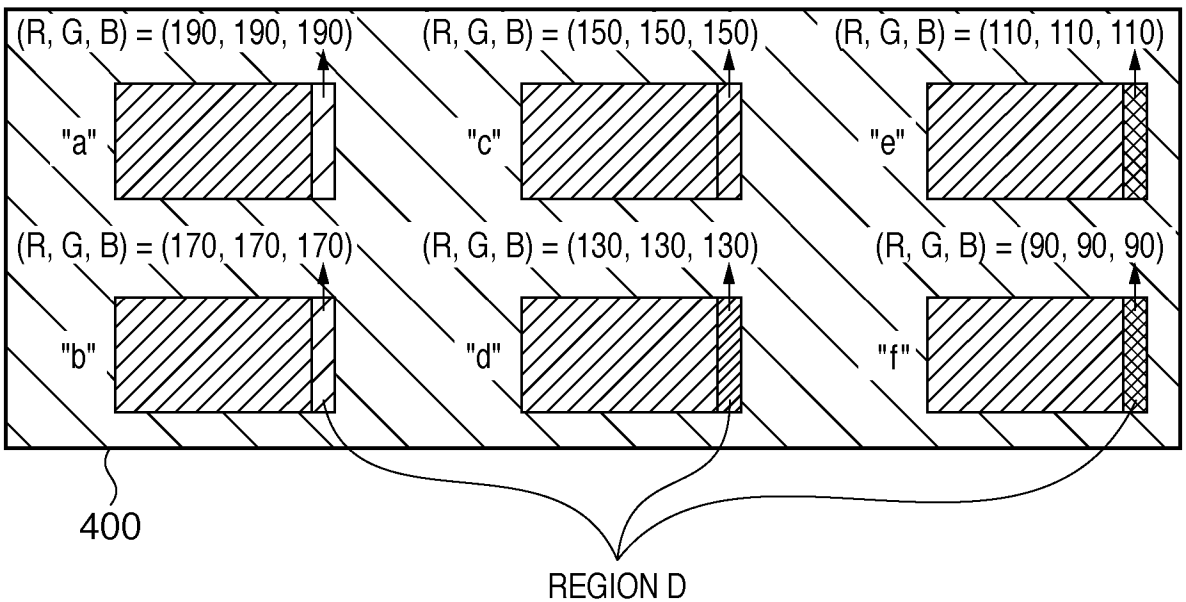
FIG. 4 is a view for explaining six sample images generated by a sample image generating unit 103.

FIG. 4 is a view for explaining six sample images generated by the sample image generating unit 103.

The sample image generating unit 103 reads out the image data 200 from the memory unit 100 and generates a sample image by replacing the tone value of a partial region of the image data 200 with a different tone value. Note that the sample image generating unit 103 corresponds to the second display unit in the appended claims. FIG. 4 shows an example of how six sample images (a) to (f) replaced with different tone values are generated. A sample image generation sequence will be described below.

First of all, the sample image generating unit 103 reads out the image data 200 of the fixed pattern from the memory unit 100, for example, six times during one frame period. That is, each sample is identical to the image data 200 as the reference pattern image. Assume that in this case, only a partial region (region A) of the image data 200 is read out. This is because a region in which a tone value is replaced is a region corresponding to the region C described above, and the region C is included in the region A.

The sample image generating unit 103 then replaces the tone value of a partial region (end portion) of the readout region (region A) with a different tone value. A region (pseudo-afterimage region) subjected to replacement is a region corresponding to the region C described above. This region will be referred to as a region D on a sample image. That is, the width of the region D corresponds to a region in which a change in pixel value occurs between the current frame and the immediately preceding frame. More specifically, this region is determined by the refresh rate and scroll speed of the liquid crystal display panel. If, for example, the scroll pattern 300 is a moving image which scrolls to the right by 16 pixels per frame, the region D can be a rectangular region having a width of about 16 pixels on the right end of the region A.

Although any kind of value can be set as the tone value of the region D which is actually set, it suffices to roughly predict the degrees of change in the response characteristic of the liquid crystal from an operating environment including an operating temperature and operation time and set several tone values well representing coloring degrees determined by the change amounts. It also suffices to select several tone values near to the tone values of the regions A and B and set them for the region D. In this case, for example, the region D is replaced with six different gray images obtained by changing (R, G, B)=(190, 190, 190) to (R, G, B)=(90, 90, 90) by (R, G, B)=(20, 20, 20) at a time. The purpose of changing the tone value of the region D is to statically display image candidates similar to the scroll pattern 300 having the region C as a plurality of still patterns.

When overdrive driving is performed on the scroll pattern 300 with an optimal correction amount, the tone value of the region C is (R, G, B)=(150, 150, 150). If, however, the correction amount is not optimal, for example, the tone value becomes (R, G, B)=(120, 120, 120) or the color balance deteriorates to (R, G, B)=(120, 150, 160). It is, however, difficult to accurately determine in advance how the region C is displayed, because it changes depending on a difference in operating environment. For this reason, the first embodiment is configured to make the user select a still pattern (sample image) most similar to the display of the region C of the scroll pattern 300, thereby uniquely determining it.

Setting User Interface (UI)

Figure 5:
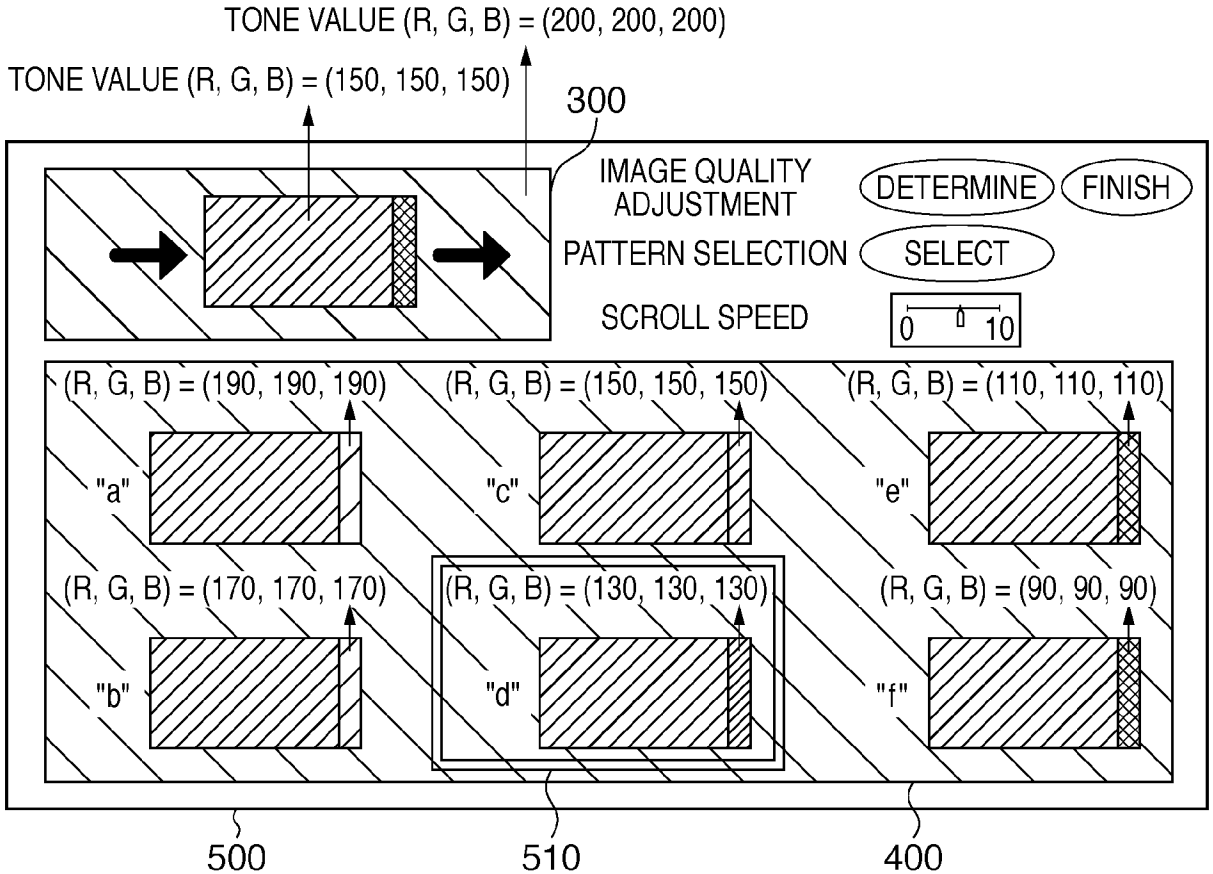
FIG. 5 is a view showing an example of an image quality adjustment window on the liquid crystal display device according to the first embodiment.

FIG. 5 is a view showing an example of an image quality adjustment window on the liquid crystal display device according to the first embodiment. An image quality adjustment window 500 is displayed when, for example, the user operates the operation unit 106. When, for example, the user presses an image quality setting button on a remote controller, the image quality adjustment function is invoked, and the image quality adjustment window 500 is displayed. Note that the image quality adjustment window 500 is an image output from the mixing unit 105. The user operates the operation unit 106 to issue an instruction to determine an image quality adjustment value, an instruction to select the image data of a fixed pattern to be used, an instruction to change a scroll speed or direction, and the like.

In the case shown in FIG. 5, the scroll pattern 300 described above is placed in the upper left region (in the first region) of the setting window. A selection window 400 on which a plurality of sample patterns is shown is placed in the lower region (in the second region) of the setting window. In addition, buttons and the like generated by the OSD generating unit 104 are arranged in the upper right region of the setting window. Although the arrangement of the respective portions can be arbitrarily determined, it is preferable to display them within the same window.

The scroll processing unit 101 selects image data to be read out from the memory unit 100 based on a user instruction to select the image data of a fixed pattern. The following description is based on the assumption that the image data 200 has been selected. The scroll processing unit 101 changes the scroll speed to a desired speed by changing the reading and outputting of the image data 200 from the memory unit 100 based on the operation of a slider for scroll speed adjustment via the operation unit 106. On the image quality adjustment window 500, a plurality of sample images shown in FIG. 4 are arranged as the selection window 400. This window is configured to allow the user to select a sample image by moving a cursor 510 via the operation unit 106.

<Operation of Device>

Figure 7:
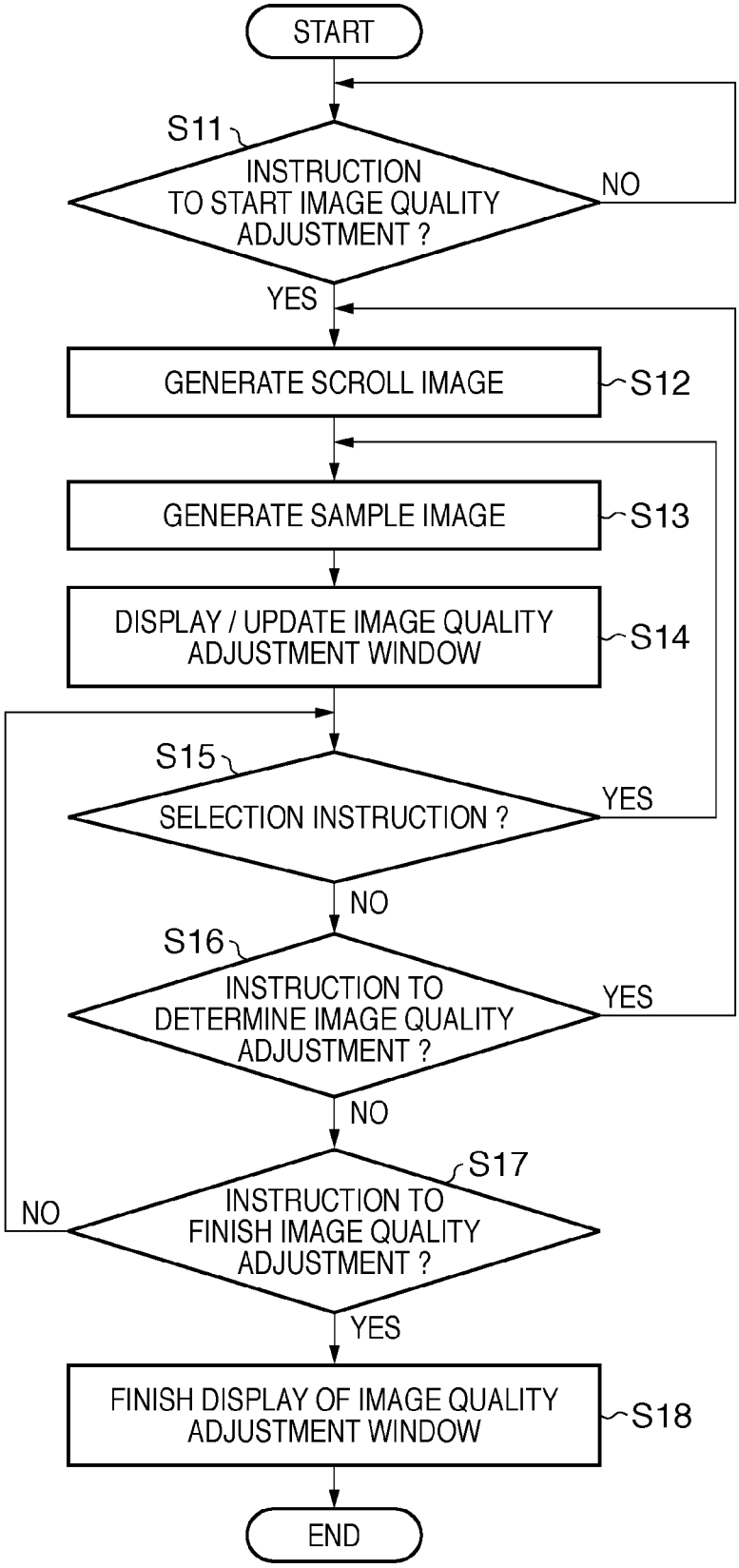
FIG. 7 is a flowchart showing image quality adjustment processing in the liquid crystal display device according to the first embodiment.

FIG. 7 is a flowchart showing image quality adjustment processing in the liquid crystal display device according to the first embodiment. Note that the following sequence is implemented by causing a CPU (not shown) of the liquid crystal display device to execute an image quality adjustment program.

The CPU determines in step S11 whether the user has issued an instruction to start image quality adjustment via the operation unit 106. If the user has issued an instruction to start image quality adjustment, the process advances to step S12.

In step S12, the scroll processing unit 101 reads the image data 200 from the memory unit 100 and starts generating a scroll image. The OD driving adjustment unit 102 sets, for example, a correction amount for an initially set value (default value) based on a correction table, and starts performing OD driving correction processing for a scroll pattern.

In step S13, the sample image generating unit 103 reads the image data 200 from the memory unit 100 and generates the above sample image.

In step S14, the CPU displays the image quality adjustment window 500. The CPU then accepts setting for an instruction from the user to select a type of fixed pattern or an instruction to change a scroll speed or direction. At this time, the CPU sets the following tone values in the regions D of six sample images (a) to (f) on the selection window 400:

(a): (R, G, B)=(190, 190, 190)
(b): (R, G, B)=(170, 170, 170)
(c): (R, G, B)=(150, 150, 150)
(d): (R, G, B)=(130, 130, 130)
(e): (R, G, B)=(110, 110, 110)
(f): (R, G, B)=(90, 90, 90)

In step S15, the CPU determines whether the user has issued an instruction to select a sample image. That is, the CPU determines whether an instruction to select a sample image most similar to the scroll pattern 300 is accepted from the user via the operation unit 106. If the user has issued an instruction to select, the process returns to step S13 to change the tone values of the six patterns (a) to (f) such that they change in increments smaller than those set previously. If the user has not issued such an instruction, the process advances to step S16.

Figure 6:
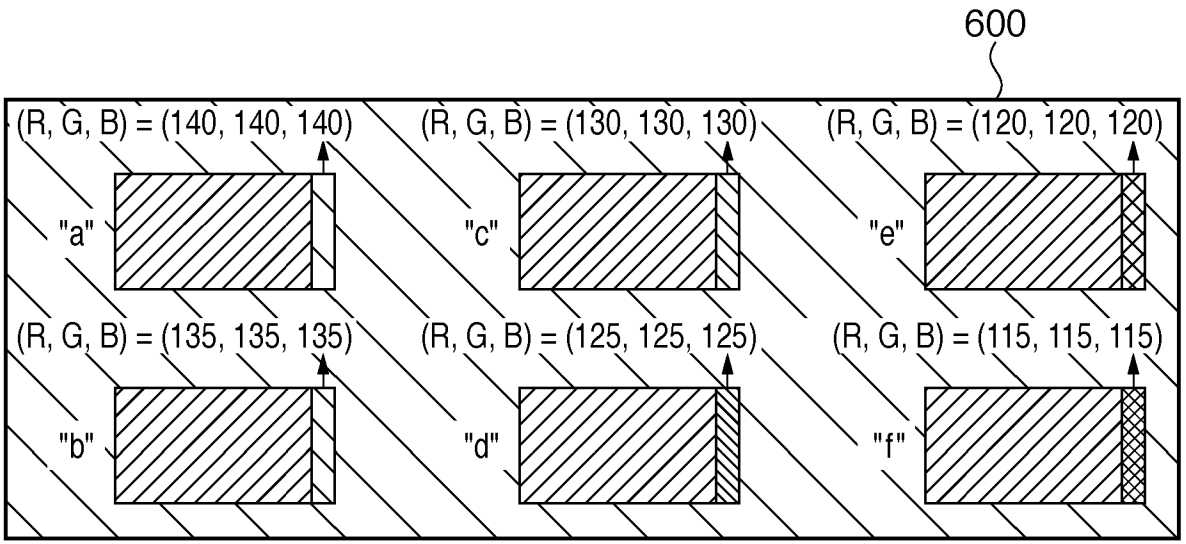
FIG. 6 is a view showing an example of the image quality adjustment window updated after sample image selection.

If, for example, an instruction to select the sample image corresponding to pattern (d), it suffices to set tone values as follows, with tone value (R, G, B)=(130, 130, 130) of (d) being a central tone value, as shown in FIG. 6:

(a): (R, G, B)=(140, 140, 140)
(b): (R, G, B)=(135, 135, 135)
(c): (R, G, B)=(130, 130, 130)
(d): (R, G, B)=(125, 125, 125)
(e): (R, G, B)=(120, 120, 120)
(f): (R, G, B)=(115, 115, 115)

The CPU then accepts an instruction to select a sample image again. The following description is based on the assumption that the CPU has accepted an instruction to select the sample image indicated by (e) in FIG. 6. That is, the coloring degree of the scroll pattern 300 is determined as (R, G, B)=(120, 120, 120).

In step S16, the CPU determines whether the user has issued an instruction to determine image quality adjustment. More specifically, the CPU determines whether the user has pressed the "decision" button on the image quality adjustment window 500. If the user has issued an instruction to determine image quality determination, the sample image generating unit 103 transmits a determined tone value to the OD driving adjustment unit 102. The OD driving adjustment unit 102 changes (updates) the adjustment value for overdrive driving based on the transmitted tone value.

When the adjustment value for overdrive driving is changed (updated), overdrive driving based on the new adjustment value is performed, and the result is reflected in the scroll pattern 300. If the user has not issued an instruction to determine image quality adjustment, the process advances to step S17.

Note that the OD driving adjustment unit 102 adjusts a correction amount for overdrive driving based on the following equation:

$$\alpha'='+k(I_n-P)$$

where $I_n$: the tone value of the current frame $I_{n-1}$: the tone value of the immediately preceding frame $\alpha$: a correction amount for overdrive driving which is calculated from a combination of $I_n$ and $I_{n-1}$ ($\alpha$ includes positive/negative sign information. If $I_{n-1}>I_n$, $\alpha\leqq 0$. If $I_{n-1}\leqq I_n$, $\alpha\geqq 0$.)

P: a tone value ($0\leqq P\leqq 255$) to be sent from the sample image generating unit 103 to the OD driving adjustment unit 102

$\alpha'$: a correction amount for overdrive driving after adjustment k: a coefficient equal to or larger than 0

Note that the above equation can be applied to each of R, G, and B as a plurality of reference colors. In this case, the correction amount $\alpha$ also has a correction amount unique to each of R, G, and B. The coefficient k may be a fixed value or may be held in advance in the form of a table in correspondence with each tone value combination.

Note that the manner of deriving $\alpha'$ is not limited to the above equation, and it suffices to use an arbitrary technique as long as it compensates for overcorrection/undercorrection based on the information (tone value) transmitted from the sample image generating unit 103 to the OD driving adjustment unit 102. For example, a correction amount can be adjusted by $$\alpha'=\alpha+\alpha\cdot k(I_n-P)$$

In step S17, the CPU determines whether the user has issued an instruction to finish image quality adjustment. More specifically, the CPU determines whether the user has pressed the "finish" button on the image quality adjustment window 500. If the user has issued an instruction to finish image quality adjustment, the process advances to step S18. Otherwise, the process returns to step S15.

In step S18, the CPU turns off the display of the image quality adjustment window and terminates the image quality adjustment function.

As described above, the liquid crystal display device according to the first embodiment allows the user to easily set a correction amount in overdrive driving of the liquid crystal display device. That is, the user is only required to select a sample image similar to the scroll pattern 300 displayed on the image quality adjustment window 500. The liquid crystal display device can uniquely determine a current display state based on the sample image selected by the user. This makes it possible to set a more suitable correction amount for overdrive driving more accurately.

Note that it suffices to change, based on the difference value between correction amounts before and after adjustment, a correction amount based on a combination of other tones in the OD driving adjustment unit 102. In addition, this device may be configured to set a table for user adjustment in a rewritable nonvolatile memory such as a flash memory.

Second Embodiment

A liquid crystal display device will be exemplarily described below as the second embodiment of the display control apparatus according to the present invention. The second embodiment will exemplify a case in which a correction amount for overdrive driving is adjusted by transmitting a tone value to an OD driving adjustment unit 102 at the timing when a user issues a selection instruction. Note that the device arrangement is the same as that of the first embodiment, and hence a repetitive description will be omitted.

<Operation of Device>

Figure 8:
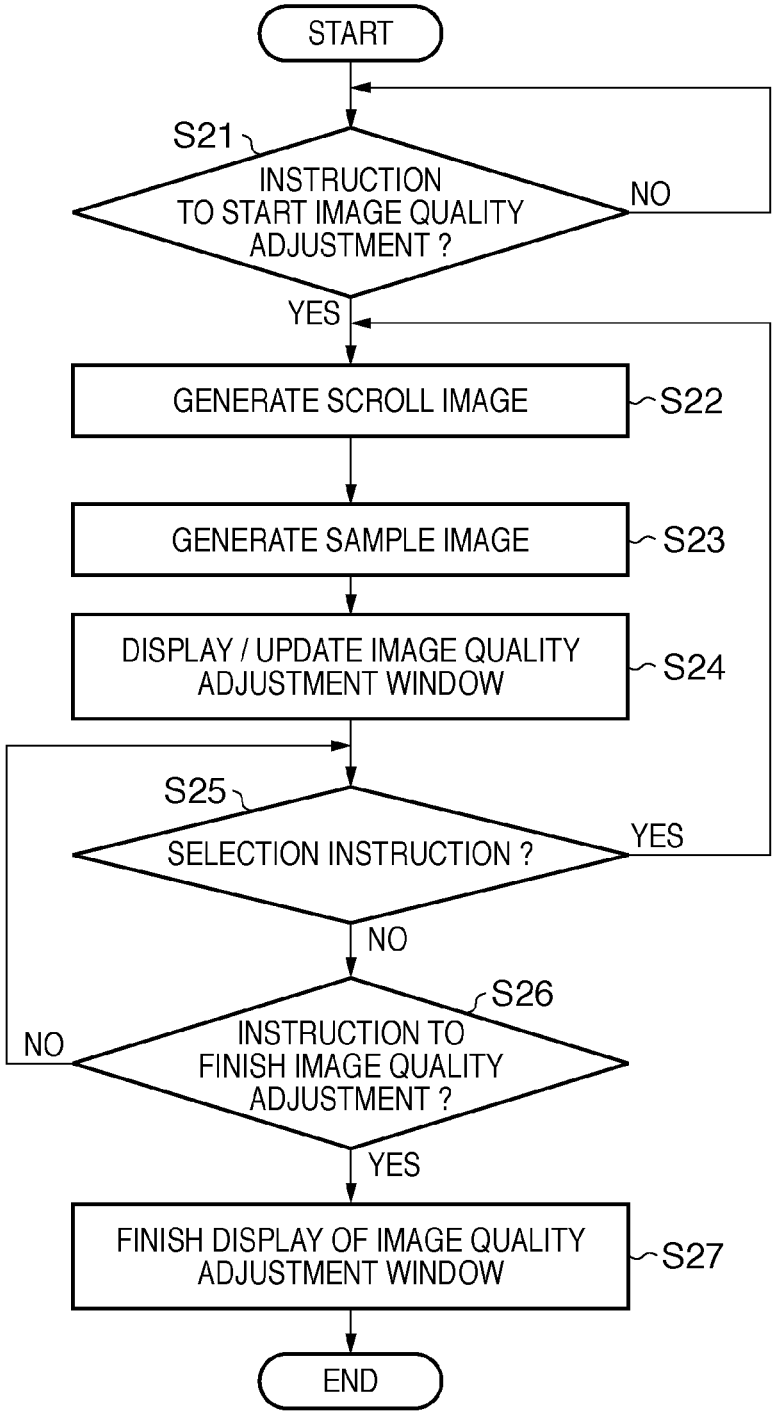
FIG. 8 is a flowchart showing image quality adjustment processing in a liquid crystal display device according to the second embodiment.

FIG. 8 is a flowchart showing an image quality adjustment sequence in the liquid crystal display device according to the second embodiment. Note that the following sequence is executed by causing a CPU (not shown) of the liquid crystal display device to execute the image quality adjustment program. Note that the processing from step S21 to step S24 is the same as that from step S11 to step S14 in the first embodiment.

In step S25, the CPU determines whether the user has issued an instruction to select a sample image. That is, the CPU determines whether the selection of a sample image most similar to a scroll pattern 300 is accepted from the user via an operation unit 106. If the user has issued an instruction to select, a sample image generating unit 103 transmits the selected tone value to the OD driving adjustment unit 102. The OD driving adjustment unit 102 changes (updates) the adjustment value for overdrive driving based on the transmitted tone value. If the user has not issued any selection instruction, the CPU determines whether an instruction to finish image quality adjustment is received (step S26). If the user has issued an instruction to finish image quality adjustment, the CPU terminates image quality adjustment processing (step S27).

As described above, the liquid crystal display device according to the second embodiment allows the user to easily set a correction amount in overdrive driving of the liquid crystal display device as in the first embodiment. Selecting a sample image will sequentially update an adjustment value for overdrive driving. This operation is then reflected in a scroll pattern to be displayed. This allows the user to accurately select a sample image most similar to the scroll pattern 300.

(Modification 1)

Modification 1 exemplifies a case in which a chromatic sample image is generated instead of the sample image described in the first embodiment.

It suffices to set, as sample images to be displayed on a selection window 400 included in an image quality adjustment window 500, for example, (a): (R, G, B)=(180, 140, 140)

(b): (R, G, B)=(150, 170, 150)

(a) a pattern colored in red or the like and (b) a pattern colored in green or the like. In this case, if the pattern (a) is selected, the CPU determines, based on the degree of coloring, that the scroll pattern 300 is reddish. It therefore suffices to prepare six types of patterns to be displayed next on the updated selection window 400 by changing only the tone value of R without changing the tone values of G and B.

(Modification 2)

In modification 2, an adjustment slider is provided for the image quality adjustment window 500 to allow the user to directly change an adjustment amount in the OD driving adjustment unit 102. Since the arrangement and operation of this device are almost the same as those in the first embodiment, a repetitive description will be omitted.

Figure 9:
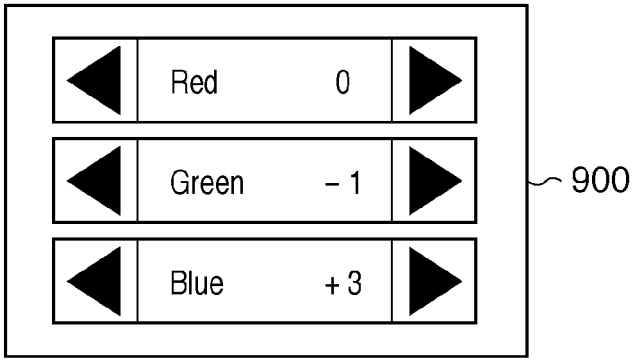
FIG. 9 is a view showing an adjustment slider 900 included in an image quality adjustment window on the liquid crystal display device according to the second modification.

FIG. 9 is a view showing an adjustment slider 900 included in an image quality adjustment window on a liquid crystal display device according to modification 2.

The adjustment slider 900 is a UI for allowing the user to directly adjust each of correction values for red, green, and blue. After, for example, adjustment is performed by the processing sequences in the first and second embodiments, the correction amount is finely adjusted via the adjustment slider 900. This makes it possible to adjust the correction amount with higher accuracy.

(Modification 3)

In modification 3, an adjustment slider is provided for the image quality adjustment window 500 to allow the user to directly change an adjustment amount in the OD driving adjustment unit 102. Since the arrangement and operation of this device are almost the same as those in the first embodiment, a repetitive description will be omitted.

The adjustment slider 900 is a UI on the image quality adjustment window 500 for allowing the user to directly adjust each of correction values for red, green, and blue. One sample image is displayed on the selection window 400 of the image quality adjustment window 500. Note that the tone value of the region D is dynamically changed by operating the adjustment slider 900.

That is, the user operates the adjustment slider 900 to make sample image coloring equal to coloring of the scroll pattern 300. Upon determining that the coloring degrees become equal, the user issues an instruction to determine image quality adjustment. Upon receiving an instruction to determine image quality adjustment, the OD driving adjustment unit 102 adjusts a correction amount for overdrive driving based on the tone value set by the user and the equation described in the first embodiment.

Forming such a UI makes it possible to apply the present invention to a case in which it is difficult to display a plurality of patterns on the selection window 400 because the display window is small.

Other Embodiments

Although the embodiments of the present invention have been described in detail above, the present invention can be applied to a system including a plurality of devices, or to an apparatus including a single device.

Note that the present invention can also be implemented by acquiring programs which implement the functions of the above embodiments via a network or a various kinds of storage media and causing a processor such as a computer to execute the programs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-140035, filed May 28, 2008, which is hereby incorporated by reference herein in its entirety.

What is claimed is:

1. A display control apparatus which determines a driving parameter for overdrive of a liquid crystal display device, the apparatus comprising:

a first display unit which repeatedly scrolls, in one direction, a preset reference pattern image in a first region of the liquid crystal display device;

a second display unit which statically displays, in a second region of the liquid crystal display device, a plurality of sample images each having a shape identical to the shape of the reference pattern image and having pseudo-afterimage regions at end portions in a direction of the scrolling, wherein brightness values of each pseudo-afterimage region are different from each other within a first predetermined brightness values range;

a selection acceptance unit which accepts selection of one sample image of the plurality of sample images statically displayed in the second region from a user; and a determination unit which determines the driving parameter for overdrive based on a difference between a pixel value of the pseudo-afterimage region of a selected sample image and a pixel value of a region corresponding to the pseudo-afterimage region of the reference pattern image, wherein, responsive to the selection acceptance unit accepting selection of one sample image, the second display unit statically displays a plurality of sample images each having a shape identical to the shape of the reference pattern image and having pseudo-afterimage regions at end portions in a direction of the scrolling, wherein brightness values of each pseudo-afterimage regions are different from each other within a second predetermined brightness values range that is narrower than the first predetermined brightness values range.

2. The apparatus according to claim 1, wherein the pseudo-afterimage region of the sample image is a region whose pixel value differs between a current display frame, which is scrolled by the first display unit, and an immediately preceding display frame.

3. The apparatus according to claim 1, wherein said determination unit independently determines the driving parameter for overdrive for each of a plurality of reference colors.

4. A method of determining a driving parameter for overdrive of a liquid crystal display device, the method comprising:

a first display step of repeatedly scrolling, in one direction, a preset reference pattern image in a first region of the liquid crystal display device;

a second display step of statically displaying, in a second region of the liquid crystal display device, a plurality of sample images each having a shape identical to the shape of the reference pattern image and sample images having pseudo-afterimage regions at end portions in a direction of the scrolling, wherein brightness values of each pseudo-afterimage region are different from each other within a first predetermined brightness values range;

a selection acceptance step of accepting selection of one sample image of the plurality of sample images statically displayed in the second region from a user; and a determination step of determining the driving parameter for overdrive based on a difference between a pixel value of the pseudo-afterimage region of a selected sample image and a pixel value of a region corresponding to the pseudo-afterimage region of the reference pattern image; and responsive to acceptance of a selection of one sample image in the selection acceptance step, a third display step of statically displaying a plurality of sample images, in substitution of the plurality of sample images displayed by the second display step, each having a shape identical to the shape of the reference pattern image and having pseudo-afterimage regions at brightness values of end portions in a direction of the scrolling, wherein brightness values of each pseudo-afterimage region are different from each other within a second predetermined brightness values range that is narrower than the first predetermined brightness values range.

* * * * *